US011047028B2

(12) United States Patent
Wennberg et al.

(10) Patent No.: US 11,047,028 B2
(45) **Date of Patent: *Jun. 29, 2021**

(54) DRILL COMPONENT

(71) Applicant: SANDVIK INTELLECTUAL PROPERTY AB, Sandviken (SE)

(72) Inventors: Anna Wennberg, Storvik (SE); Tomas Antonsson, Sandviken (SE); Lars Nylof, Gavle (SE)

(73) Assignee: Sandvik Intellectual Property AB, Sandviken (SE)

( * ) Notice: Subject to any disclaimer, the term of this patent is extended or adjusted under 35 U.S.C. 154(b) by 185 days.

This patent is subject to a terminal disclaimer.

(21) Appl. No.: 15/745,077

(22) PCT Filed: Jul. 14, 2016

(86) PCT No.: PCT/EP2016/066811
§ 371 (c)(1),
(2) Date: Jan. 15, 2018

(87) PCT Pub. No.: WO2017/009436
PCT Pub. Date: Jan. 19, 2017

(65) Prior Publication Data

US 2018/0209024 A1 Jul. 26, 2018

(30) Foreign Application Priority Data

Jul. 16, 2015 (EP) ..... 15176999

(51) Int. Cl.
*C22C 38/00* (2006.01)
*C22C 38/02* (2006.01)
(Continued)

(52) U.S. Cl.
CPC ..... *C22C 38/52* (2013.01); *C21D 1/25* (2013.01); *C21D 6/007* (2013.01); *C21D 9/22* (2013.01);
(Continued)

(58) Field of Classification Search
None
See application file for complete search history.

(56) References Cited

U.S. PATENT DOCUMENTS 5,714,114 A * 2/1998 Uehara ..... C22C 38/20 148/325
8,118,116 B2 * 2/2012 Linden ..... C21D 9/0075 148/325
2009/0013831 A1 1/2009 Linden

FOREIGN PATENT DOCUMENTS

CN 1145644 A 3/1997
CN 102586695 A 7/2012
(Continued)

OTHER PUBLICATIONS

Translation of Office Action dated Mar. 31, 2020, issued in corresponding Japanese Patent Application 2018-501875.
(Continued)

*Primary Examiner* — Anthony J Zimmer
*Assistant Examiner* — Michael J Kachmarik
(74) *Attorney, Agent, or Firm* — Morgan, Lewis & Bockius LLP

(57) ABSTRACT

The present disclosure relates to a drill component having a martensitic stainless steel which has good corrosion resistance in combination with optimized and well-balanced mechanical properties, such as high hardness, resistance against wear and abrasion, high tensile strength and high impact toughness.

18 Claims, 3 Drawing Sheets

(51) Int. Cl.

| | |
|---|---|
| ***C22C 38/04*** | (2006.01) |
| ***C22C 38/06*** | (2006.01) |
| ***C22C 38/18*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C21D 1/25*** | (2006.01) |
| ***C21D 6/00*** | (2006.01) |
| ***C21D 9/22*** | (2006.01) |
| ***C21D 9/52*** | (2006.01) |
| *C21D 7/06* | (2006.01) |

(52) U.S. Cl.

CPC ..... *C21D 9/525* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 6/004* (2013.01); *C21D 7/06* (2013.01); *C21D 2211/001* (2013.01); *C21D 2211/008* (2013.01)

(56) References Cited

FOREIGN PATENT DOCUMENTS

| | | | |
|---|---|---|---|
| CN | 103614649 | A | 3/2014 |
| JP | S53-031516 | A | 3/1978 |
| JP | S58-199850 | A | 11/1983 |
| JP | S61-207550 | A | 9/1986 |
| JP | H10-504354 | A | 4/1998 |
| JP | 2018-524473 | A | 8/2018 |
| WO | 0161064 | A1 | 8/2001 |
| WO | 2009008798 | A1 | 1/2009 |
| WO | 2017/009436 | A1 | 1/2017 |

OTHER PUBLICATIONS

Chaocong Yang, et al., "Metallic Materials", Shenyang: Northeastern University Press, Apr. 30, 2014, pp. 106-108.

Office Action dated Jun. 24, 2020 issued in Chinese Application No. 201680041848.6.

* cited by examiner

DRILL COMPONENT

RELATED APPLICATION DATA

This application is a § 371 National Stage Application of PCT International Application No. PCT/EP2016/066811 filed Jul. 14, 2016 claiming priority to EP 15176999.9 filed Jul. 16, 2015.

PARTIES TO JOINT RESEARCH AGREEMENT

This invention was developed under and was made as a result of activities undertaken within the scope of a Joint Research Agreement between Sandvik Intellectual Property AB and Sandvik Materials Technology (now AB SMT), which agreement was in effect on and before the date the claimed invention was made.

TECHNICAL FIELD

The present disclosure relates to a drill component, especially a drill rod comprising a martensitic stainless steel and to the manufacture thereof.

BACKGROUND

During rock drilling, shock waves and rotation are transferred from a drill rig via one or more rods or tubes to a cemented carbide equipped drill bit. The drill rod is subjected to severe mechanical loads as well as corrosive environment. This applies in particular to underground drilling, where water is used as flushing medium and where the environment, in general, is humid. The corrosion is particularly serious in the most stressed parts, i.e. thread bottoms and thread clearances.

Normally, low-alloyed case hardened steels are used for the drilling application. Such steels have the limitation of a relatively short service life due to corrosion fatigue, which results in an accelerated breakage of the drill rod, caused by dynamic loads and insufficient corrosion resistance of the rod material. Another problem related to drill rods is the rate by which the drill rods wear out and have to be replaced due to abrasion, i.e. insufficient hardness of the rod material, which has a direct impact on the total cost for the drilling operation. A further problem related to drill rods is the strength and toughness of the rod material, especially impact toughness, i.e. the ability of the drill rod to withstand the static and dynamic loads, as well as shock loads, caused by rock drilling. If a rod breaks, it may take considerable time to retrieve it from the drill hole. The breaking of a rod may also disturb the calculated drill pattern for the optimized blasting. Additional problems relating to the breaking of drill rods and drill bits is the damage to the mining and tunnelling equipment, e.g. crushers and sieves.

Both WO0161064 and WO2009008798 disclose martensitic steels for rock drilling. Even though these steels will solve or reduce the above problem with corrosion fatigue, these martensitic steels will not possess impact toughness high enough to be fully operative during rock drilling. This will mean that the drill components made thereof will have an obvious risk of easy breakage when subjected to shock loads during rock drilling, which may lead to the same consequences as mentioned above.

Both CN 102586695 and U.S. Pat. No. 5,714,114 relate to a martensitic steel. However, the martensitic stainless steels disclosed therein are used for other applications than drill rods. Thus, the requirements and important mechanical properties of the martensitic stainless steels disclosed therein are different compared to a martensitic stainless steel used for drill rods.

Consequently, it is an object of the present disclosure to solve and/or to reduce at least one of the above problems. In particular, it is an aspect of the present disclosure to achieve a drill component, such as a drill rod, having a steel composition which forms a martensitic microstructure upon hardening which will provide the drill component with good corrosion resistance and optimized and well-balanced mechanical properties, thus resulting in an increased service life, thereby also achieving a cost effective drill component which can be used over a long period of time.

SUMMARY

The present disclosure therefore relates to a drill component comprising a martensitic stainless steel having the following composition in weight % (wt %):

| | |
|---|---|
| C | 0.21 to 0.27; |
| Si | less than or equal to 0.7; |
| Mn | 0.2 to 2.5; |
| P | less than or equal to 0.03; |
| S | less than or equal to 0.05; |
| Cr | 11.9 to 14.0; |
| Ni | more than 0.5 to 3.0; |
| Mo | 0.4 to 1.5; |
| N | less than or equal to 0.060; |
| Cu | less than or equal to 1.2; |
| V | less than or equal to 0.06; |
| Nb | less than or equal to 0.03; |
| Al | less than or equal to 0.050; |
| Ti | less than or equal to 0.05; |

balance Fe and unavoidable impurities, wherein the martensitic stainless steel comprises more than or equal to 75% martensite phase and less than or equal to 25% retained austenite phase and wherein the PRE-value (pitting resistance equivalent value) is more than or equal to 14. The PRE value is calculated by the following equation PRE=Cr+3.3*Mo, wherein Cr and Mo correspond to the contents of the elements in weight percent (wt %). The martensitic stainless steel as defined hereinabove or hereinafter has a hardened and tempered martensitic microstructure containing retained austenite meaning that the martensitic microstructure comprises both martensite phase and retained austenite phase. The martensite phase will provide the desired hardness and tensile strength and also the desired resistance to wear. The retained austenite phase, which is softer and more ductile compared to the martensite phase, will reduce the brittleness of the martensitic microstructure and thereby provide a necessary improvement in the mechanical properties of the steel, such as impact toughness. The martensitic stainless steel as defined herein above or hereinafter will due to both its chemical composition and its microstructure have a unique combination of hardness, impact toughness, strength, and corrosion resistance.

Furthermore, the present disclosure also relates a to drill component which is a drill rod, such as a top hammer drill rod and a water flushed top hammer drill rod, and the manufacture thereof.

DETAILED DESCRIPTION

Figure 1:
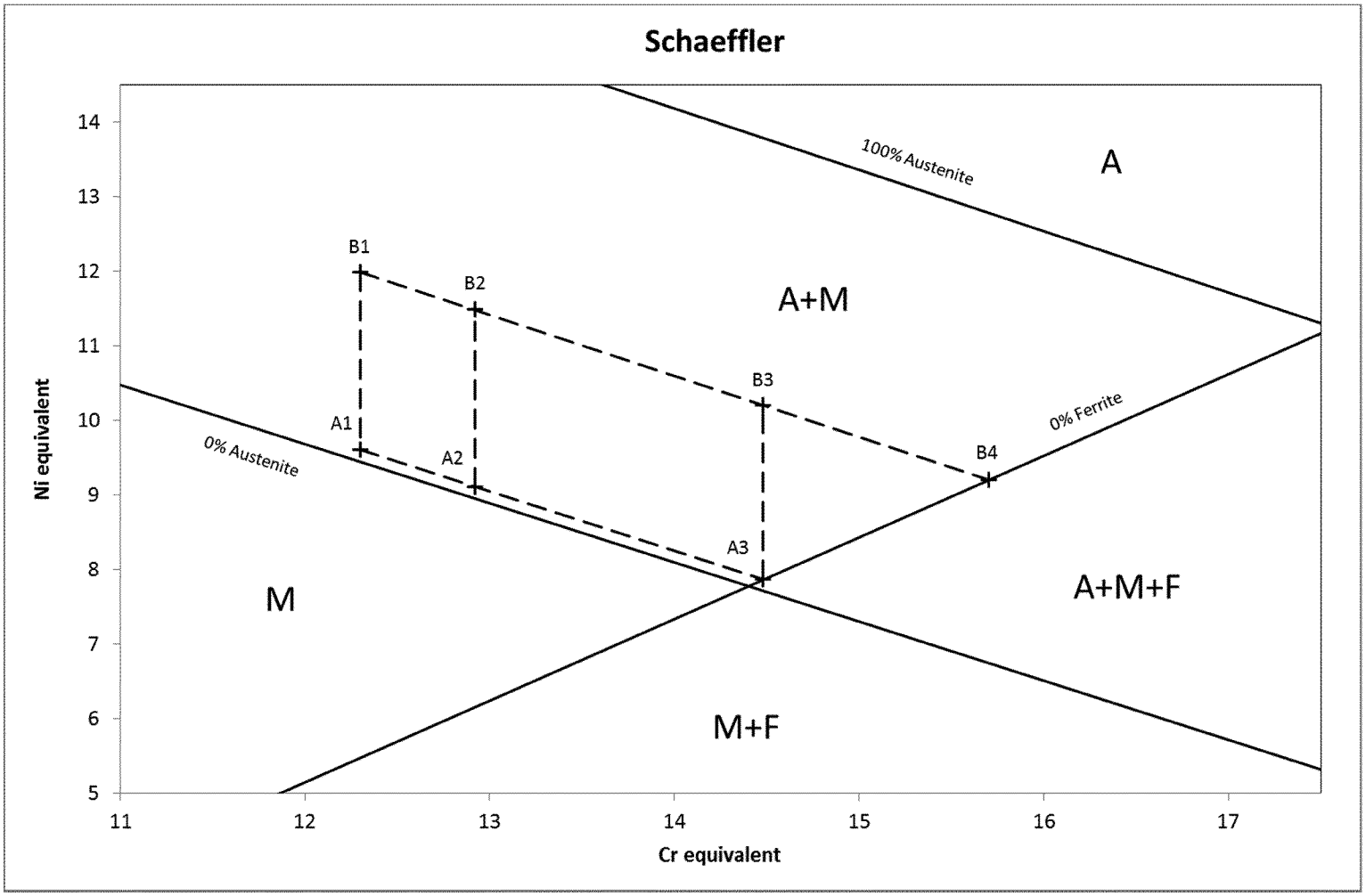
FIG. 1 shows the Schaeffler diagram wherein the area and the corresponding coordinates have been drawn.

The present disclosure therefore relates to a drill component comprising a martensitic stainless steel having the following composition in weight % (wt %):

| | |
|---|---|
| C | 0.21 to 0.27; |
| Si | less than or equal to 0.7; |
| Mn | 0.2 to 2.5; |
| P | less than or equal to 0.03; |
| S | less than or equal to 0.05; |
| Cr | 11.9 to 14.0; |
| Ni | more than 0.5 to 3.0; |
| Mo | 0.4 to 1.5; |
| N | less than or equal to 0.060; |
| Cu | less than or equal to 1.2; |
| V | less than or equal to 0.06; |
| Nb | less than or equal to 0.03; |
| Al | less than or equal to 0.050; |
| Ti | less than or equal to 0.05; |

balance Fe and unavoidable impurities, wherein the martensitic stainless steel comprises more than or equal to 75% martensite phase and less than or equal to 25% retained austenite phase, wherein the PRE-value is more than or equal to 14.

Further, the present martensitic stainless steel will have high tensile strength and high wear resistance due to a high hardness of the martensite phase. The martensite phase is however brittle. In the present disclosure, it has been found that by combining the martensite phase with a certain amount of retained austenite phase (such that the microstructure comprises more than or equal to 75% martensite phase and less than or equal to 25% retained austenite phase), and further by combining this with a balanced addition of alloying elements, especially Ni, Mn and Mo, the impact toughness of the martensitic stainless steel will be greatly improved, which means that this also is true for the drill component comprising the martensitic stainless steel. This is due to that the martensite phase will, as mentioned above, provide the desired hardness and tensile strength and also the desired resistance to wear while the retained austenite phase, which is softer and more ductile compared to the martensite phase, will reduce the brittleness of the martensitic microstructure and thereby provide a necessary improvement in the mechanical properties. It is however necessary that there is not a too high amount of retained austenite phase as this will reduce the hardness of the martensitic microstructure too much. Thus, the amount of martensite phase and the amount of retained austenite phase is as defined hereinabove or hereinafter. According to one embodiment, the martensitic stainless steel as defined hereinabove or hereinafter does not contain any ferrite phase after hardening, which in this context is considered to be a soft and brittle phase, i.e. the drill component which comprises the martensitic stainless steel as defined hereinabove or hereinafter does not contain any ferrite phase after hardening.

According to one embodiment of the present disclosure, the martensitic stainless steel as defined hereinabove or hereinafter, which the drill component is comprised of, comprises of from 80 to 95% martensite phase and of from 5 to 20% retained austenite phase.

Hence, the present disclosure provides a martensitic stainless steel having a unique combination of high hardness and high impact toughness as well as good corrosion resistance. Additionally, the present disclosure provides a drill component comprising a martensitic stainless steel which has a chemical composition and microstructure that will provide the drill component with an optimal combination of corrosion resistance, hardness and impact toughness throughout the whole component. Thus, the drill component will have an improved cost efficiency and longer operation time in service.

The alloying elements of the martensitic stainless steel according to the present disclosure will now be described. The terms "weight %" and "wt %" are used interchangeably:

Carbon (C): 0.21 to 0.27 wt %

C is a strong austenite phase stabilizing alloying element. C is necessary for the martensitic stainless steel so that said steel has the ability to be hardened and strengthened by heat treatment. The C-content is therefore set to be at least 0.21 wt % so as to sufficiently achieve the before mentioned effects. However, an excess of C will increase the risk of forming chromium carbide, which would thus reduce various mechanical properties and other properties, such as ductility, impact toughness and corrosion resistance. The mechanical properties are also affected by the amount of retained austenite phase after hardening and this amount will depend on the C-content. Accordingly, the C-content is set to be at most 0.27 wt %, thus the carbon content of the present martensitic stainless steel is of from about 0.21 to 0.27 wt %, such as of from 0.21 to 0.26 wt %.

Silicon (Si): Max 0.7 wt %

Si is a strong ferrite phase stabilizing alloying element and therefore its content will also depend on the amounts of the other ferrite forming elements, such as Cr and Mo. Si is mainly used as a deoxidizer agent during melt refining. If the Si-content is excessive, ferrite phase as well as intermetallic precipitates may be formed in the microstructure, which will reduce various mechanical properties. Accordingly, the Si-content is set to be max 0.7 wt %, such as max 0.4 wt %.

Manganese (Mn): 0.2 to 2.5 wt %

Mn is an austenite phase stabilizing alloying element. Mn will promote the solubility of C and N in the austenite phase and will increase the deformation hardening. Furthermore, Mn will also increase hardenability when the martensitic stainless steel is heat treated. Mn will further reduce the detrimental effect of sulphur by forming MnS precipitates, which in turn will enhance the hot ductility and the impact toughness, but MnS precipitates may also impair the pitting corrosion resistance somewhat. Therefore, the lowest Mn-content is set to be 0.2 wt %. However, if the Mn-content is excessive, the amount of retained austenite phase may become too large and various mechanical properties, as well as hardness and corrosion resistance, may be reduced. Also, a too high content of Mn will reduce the hot working properties and also impair the surface quality. The Mn-content is therefore set to be at most 2.5 wt %. Hence, the content of Mn is of from 0.2 to 2.5 wt %, such as 0.3 to 2.4 wt %. Additionally, in the present disclosure, the content of Mn, Ni and Mo comprised in the martensitic stainless steel is balanced together in order to obtain the desired properties of said martensitic stainless steel.

Chromium (Cr): 11.9 to 14.0 wt %

Cr is one of the basic alloying elements of a stainless steel and an element which will provide corrosion resistance to the steel. The martensitic stainless steel as defined hereinabove or hereinafter comprises at least 11.9 wt % in order to achieve a Cr-oxide layer and/or a passivation of the surface of the steel in air or water, thereby obtaining the basic corrosion resistance. Cr is also a ferrite phase stabilizing alloying element. However, if Cr is present in an excessive amount, the impact toughness may be decreased and additionally ferrite phase and chromium carbides may be formed upon hardening. The formation of chromium carbides will reduce the mechanical properties of the martensitic stainless steel. An increase of the Cr-content above the level for passivation of the steel surface will have only weak effects on the corrosion resistance of the martensitic stainless steel. The Cr-content is therefore set to be at most 14.0 wt %. Hence, the content of Cr is of from 11.9 to 14.0 wt %, such as 12.0 to 13.8 wt %.

Molybdenum (Mo): 0.4 to 1.5 wt %

Mo is a strong ferrite phase stabilizing alloying element and thus promotes the formation of the ferrite phase during annealing or hot-working. One major advantage of Mo is that it contributes strongly to the pitting corrosion resistance. Mo is also known to reduce the temper embrittlement in martensitic steels and thereby improves the mechanical properties. However, Mo is an expensive element and the effect on corrosion resistance is obtained even in low amounts. The lowest content of Mo is therefore 0.4 wt %. Furthermore, an excessive amount of Mo affects the austenite to martensite transformation during hardening and eventually the retained austenite phase content. Therefore, the upper limit of Mo is set at 1.5 wt %. Hence, the content of Mo is of from 0.4 to 1.5 wt %, such as 0.5 to 1.4 wt %.

Nickel (Ni): More than 0.5 to 3.0 wt %

Ni is an austenite phase stabilizing alloying element and thereby stabilize the retained austenite phase after hardening. It has also been discovered that Ni will provide a much improved impact toughness in addition to the general toughness contribution which is provided by the retained austenite phase. In the present disclosure, it has been found that by balancing the amount of Ni, Mn and Mo in the martensitic stainless steel, the best combination of hardness, impact toughness and corrosion resistance will be provided. More than 0.5 wt % Ni is required to provide a substantial effect. However, if the Ni-content is excessive, the amount of retained austenite phase will be too high and the hardness will then be insufficient. The maximum content of Ni is therefore limited to 3.0 wt %. Hence, the content of Ni is from more than 0.5 to 3.0 wt %, such as from more than 0.5 to 2.4 wt %.

Tungsten (W): Less than or Equal to 0.5 wt %

W is a ferrite phase stabilizing alloying element and if present it may to some extent replace Mo as an alloying element, due to similar chemical properties. W has a positive effect on the resistance against pitting corrosion, but the effect is much weaker than the effect of Mo, if the dissolved matrix contents are compared, which normally is the reason why W is excluded from the PRE-formula. In order to replace Mo, a much higher W-content therefore becomes necessary. W is also a carbide forming element and at high contents of W, the wear resistance will be improved, as well as hardness and strength. However, at W-contents where the above properties are improved, the amount of W-carbides will considerably decrease the impact toughness of the steel. The required W-contents will also result in an increased temperature stability of the carbides, and in order to increase the content of dissolved W in the matrix, much higher hardening temperatures are needed. The content of W is therefore set to be less than or equal to 0.5 wt %, such as less than or equal to 0.05 wt %.

Cobalt (Co): Less than or Equal to 1.0 wt %,

Cobalt has a strong solid solution effect and gives rise to a strengthening effect, which also remains at higher temperatures. Therefore, Co is often used as an alloying element to improve the high temperature strength, as well as the hardness and resistance to abrasive wear at elevated temperatures. However, at Co-contents where the effects on these properties are significantly improved, the Co-content also has an opposite effect on the hot working properties, causing higher deformation forces. Co is the only alloying element that destabilizes the austenite phase and thus facilitates the transformation of austenite, as well as retained austenite, into martensite phase or ferrite containing phases, on cooling. Due to the complex effects of Co, but also due to the fact that it is toxic, and regarded as an impurity in scrap material used for production of stainless steels intended for atomic energy applications, the content of Co, if present, is therefore set to be less than or equal to 1.0 wt %, such as less than or equal to 0.10 wt %.

Aluminum (Al) Less than or Equal to 0.050 wt %

Al is an optional element and is commonly used as a deoxidizing agent as it is effective in reducing the oxygen content during steel production. However, a too high content of Al may reduce the mechanical properties. The content of Al is therefore less than or equal to 0.050 wt %.

Nitrogen (N): Less than or Equal to 0.060 wt %

N is an optional element and is an austenite phase stabilizing alloying element and has a very strong interstitial solid solution strengthening effect. However, a too high content of N may reduce the hot working properties at high temperatures and may also reduce the impact toughness at room temperature for the present martensitic stainless steel. The N-content is therefore set to be less than or equal to 0.060 wt %, such as less than or equal to 0.035 wt %.

Vanadium (V): Less than or Equal to 0.06 wt %

V is an optional element and is a ferrite phase stabilizing alloying element which has a high affinity to C and N. V is a precipitation hardening element and is regarded as a micro-alloying element in the martensitic stainless steel and may be used for grain refinement. Grain refinement refers to a method to control grain size at high temperatures by introducing small precipitates in the microstructure, which will restrict the mobility of the grain boundaries and thereby will reduce the austenite grain growth during hot working or heat treatment. A small austenite grain size is known to improve the mechanical properties of the martensitic microstructure formed upon hardening. However, an excessive amount of V will generate a too high fraction of precipitates in the microstructure and especially increase the risk of the formation of coarser V precipitations in the prior austenite grain boundaries of the martensitic microstructure, thus reducing the ductility, especially the impact toughness. The content of V is therefore less than or equal to 0.06 wt %.

Niobium (Nb): Less than or Equal to 0.03 wt %

Nb is an optional element which is a ferrite phase stabilizing alloying element and has a high affinity to C and N. Thus, Nb is a precipitation hardening element and may be used for grain refinement, however, Nb also forms coarse precipitations. An excessive amount of Nb may therefore reduce the ductility and impact toughness of the martensitic stainless steel and the content of Nb therefore is less than or equal to 0.03 wt %.

Zirconium (Zr): Less than or Equal to 0.03 wt %

Zr is an optional element which has a very high affinity to C and N. Zirconium nitrides and carbides are stable at high temperatures and may be used for grain refinement. If the Zr-content is too high, coarse precipitations may be formed, which will decrease the impact toughness. The content of Zr is therefore less than or equal to 0.03 wt %.

Tantalum (Ta): Less than or Equal to 0.03 wt %

Ta is an optional element which has a very high affinity to C and N. Tantalum nitrides and carbides are stable at high temperatures and may be used for grain refinement. If the Ta-content is too high, coarse precipitations may be formed, which will decrease the impact toughness. The content of Ta is therefore less than or equal to 0.03 wt %.

Hafnium (Hf): Less than or Equal to 0.03 wt %

Hf is an optional element which has a very high affinity to C and N. Hafnium nitrides and carbides are stable at high temperatures and may be used for grain refinement. If the Hf-content is too high, coarse precipitations may be formed, which will decrease the impact toughness. The content of Hf is therefore less than or equal to 0.03 wt %.

Phosphorous (P): Less than or Equal to 0.03 wt %

P is an optional element and may be included as an impurity and is regarded as a harmful element. Therefore, it is desirable to have less than 0.03 wt % P.

Sulphur (S): Less than or Equal to 0.05 wt %

S is an optional element and may be included in order to improve the machinability. However, S may form grain boundary segregations and inclusions and will therefore restrict the hot working properties and also reduce the mechanical properties and corrosion resistance. Hence, the content of S should not exceed 0.05 wt %.

Titanium (Ti): Less than or Equal to 0.05 wt %

Ti is an optional element which is a ferrite phase stabilizing alloying element and has a very high affinity to C and N. Titanium nitrides and carbides are stable at high temperatures and may be used for grain refinement. If the Ti-content is too high, coarse precipitations may be formed, which will decrease the impact toughness. The content of Ti is therefore less than or equal to 0.05 wt %.

Copper (Cu) Less than or Equal to 1.2 wt %

Cu is an austenite phase stabilizing alloying element and has rather limited effects on the martensitic stainless steel in small amounts. Cu may to some extent replace Ni or Mn as austenite phase stabilizers in the martensitic stainless steel but the ductility will then be reduced compared to e.g. an addition of Ni. Cu may have a positive effect on the general corrosion resistance of the steel but higher amounts of Cu will affect the hot working properties negatively. The content of Cu is therefore less than or equal to 1.2 wt %, such as less than or equal to 0.8 wt %.

Optionally small amounts of other alloying elements may be added to the martensitic stainless steel as defined hereinabove or hereinafter in order to improve e.g. the machinability or the hot working properties, such as the hot ductility. Example, but not limiting, of such elements are Ca, Mg, B, Pb and Ce. The amounts of one or more of these elements are of max. 0.05 wt %.

When the terms "max" or "less than or equal to" are used, the skilled person knows that the lower limit of the range is 0 wt % unless another number is specifically stated.

The remainder of elements of the martensitic stainless steel as defined hereinabove or hereinafter is Iron (Fe) and normally occurring impurities.

Examples of impurities are elements and compounds which have not been added on purpose, but cannot be fully avoided as they normally occur as impurities in e.g. the raw material or the additional alloying elements used for manufacturing of the martensitic stainless steel.

According to one embodiment, the martensitic stainless steel as defined hereinabove or hereinafter, which the drill component is composed of, may also be represented by an area defined by specific coordinates in a Schaeffler diagram according to its chemical composition and its Cr- and Ni-equivalents (see FIG. 1). A Schaeffler diagram is used to predict the presence and amount of austenite (A), ferrite (F) and martensite (M) phases in the microstructure of a steel after fast cooling from a high temperature and is based on the chemical composition of the steel. The specific coordinates of the area of the present disclosure in the Schaeffler diagram have been determined by calculating the Cr- and Ni-equivalents ($Cr_{eq}$ and $Ni_{eq}$) according to the following equations (see FIG. 1):

$$Cr_{eq}=Cr+Mo+1.5*Si+0.5*Nb \quad \text{(x-axis)}$$

$$Ni_{eq}=Ni+0.5*Mn+30*N+30*C \quad \text{(y-axis)}$$

wherein the values of Cr, Mo, Si, Nb, Ni, Mn, N and C are in weight %; and where the area of the martensitic stainless steel is defined by the following coordinates (see FIG. 1 and FIG. 2):

| | $Cr_{eq}$ | $Ni_{eq}$ |
|---|---|---|
| A1 | 12.300 | 9.602 |
| B1 | 12.300 | 11.990 |
| B4 | 15.702 | 9.199 |
| A3 | 14.482 | 7.864 |

According to another embodiment of the present disclosure, the martensitic stainless steel may be represented by an area in a Schaeffler diagram defined by the following coordinates (see FIG. 1 and FIG. 2):

| | $Cr_{eq}$ | $Ni_{eq}$ |
|---|---|---|
| A2 | 12.923 | 9.105 |
| B2 | 12.923 | 11.497 |
| B4 | 15.702 | 9.199 |
| A3 | 14.482 | 7.864 |

According to another embodiment of the present disclosure, the martensitic stainless steel may be represented by an area in a Schaeffler diagram defined by the following coordinates (see FIG. 1 and FIG. 2):

| | $Cr_{eq}$ | $Ni_{eq}$ |
|---|---|---|
| A1 | 12.300 | 9.602 |
| B1 | 12.300 | 11.990 |
| B3 | 14.482 | 10.200 |
| A3 | 14.482 | 7.864 |

According to a further embodiment of the present disclosure, the martensitic stainless steel may be represented by an area in a Schaeffler diagram defined by the following coordinates (see FIG. 1 and FIG. 2):

| | $Cr_{eq}$ | $Ni_{eq}$ |
|---|---|---|
| A2 | 12.923 | 9.105 |
| B2 | 12.923 | 11.479 |
| B3 | 14.482 | 10.200 |
| A3 | 14.482 | 7.864 |

The drill component is made by using conventional drill component production processes and drill component machining processes. In order to obtain the desired martensitic structure of the drill component, the martensitic stainless steel which the drill component is composed of, has to be hardened and tempered. The mechanical properties of the surface may be further improved by induction heating of the surface or by applying surface treatment methods, such as but not limited to shot peening. The obtained drill component will have good corrosion resistance in combination with well-balanced and optimized mechanical properties, such as high hardness, resistance against wear and abrasion, high tensile strength and high impact toughness. According to one embodiment, the drill component is manufactured according to the following process comprising the steps of:

a. providing a martensitic stainless steel as defined hereinabove or hereinafter;
b. forming an object of said steel, which object may be the drill component or a pre-form of the drill component. Thus, the object may already been formed to the drill component, such as a drill rod. The object when it is a pre-form, may also be a pre-form such as a round or hexagonal billet. According to the present disclosure, the object may also be a pre-form wherein threads have been partly made, or the object may be a drill component having the final shape of threads.
c. hardening the object at a temperature of from about 1030 to about 1150° C.;
d. quenching the object;
Hardening and quenching is performed for obtaining the martensitic microstructure.
e. tempering the object at a temperature of from about 175 to about 350° C.;
Tempering is a process of heat treatment which is used for increasing the toughness.
f. forming the drill component from the object.

Examples of drill components are a drill rod, such as a top hammer drill rod. The obtained drill rods will have high hardness, resistance against wear and abrasion, high tensile strength, high impact toughness and good corrosion resistance, it should be noted that there are today no drill rods commercially available, which are made of stainless steel.

It will be appreciated by those skilled in the art that additions, modifications, substitutions and deletions not specifically described may be made without departing from the spirit and scope of the disclosure as defined in the claims.

The present disclosure is further illustrated by the following non-limiting examples.

EXAMPLES

Alloys outside the scope of the disclosure are marked with a "x" in all tables.

Example 1

The alloys of Example 1 have been produced by melting in a high frequency furnace and thereafter ingot cast using 9" steel moulds. The weights of the ingots were approximately 270 kg. The ingots were heat-treated by soft annealing at 650° C. for 4 hours and then air cooled to room temperature followed by grinding of the ingot surface.

After the heat treatment, the ingots were forged in a hammer to bars having a round dimension of approximately 145 mm. The obtained round bars were then hot rolled at 1200° C. in a rolling mill to solid hexagonal 35 mm dimension.

Samples from these bars were used for corrosion and mechanical testing.

The chemical composition of the different alloys and their corresponding alloy No. is found in Table 1.

Figure 2:
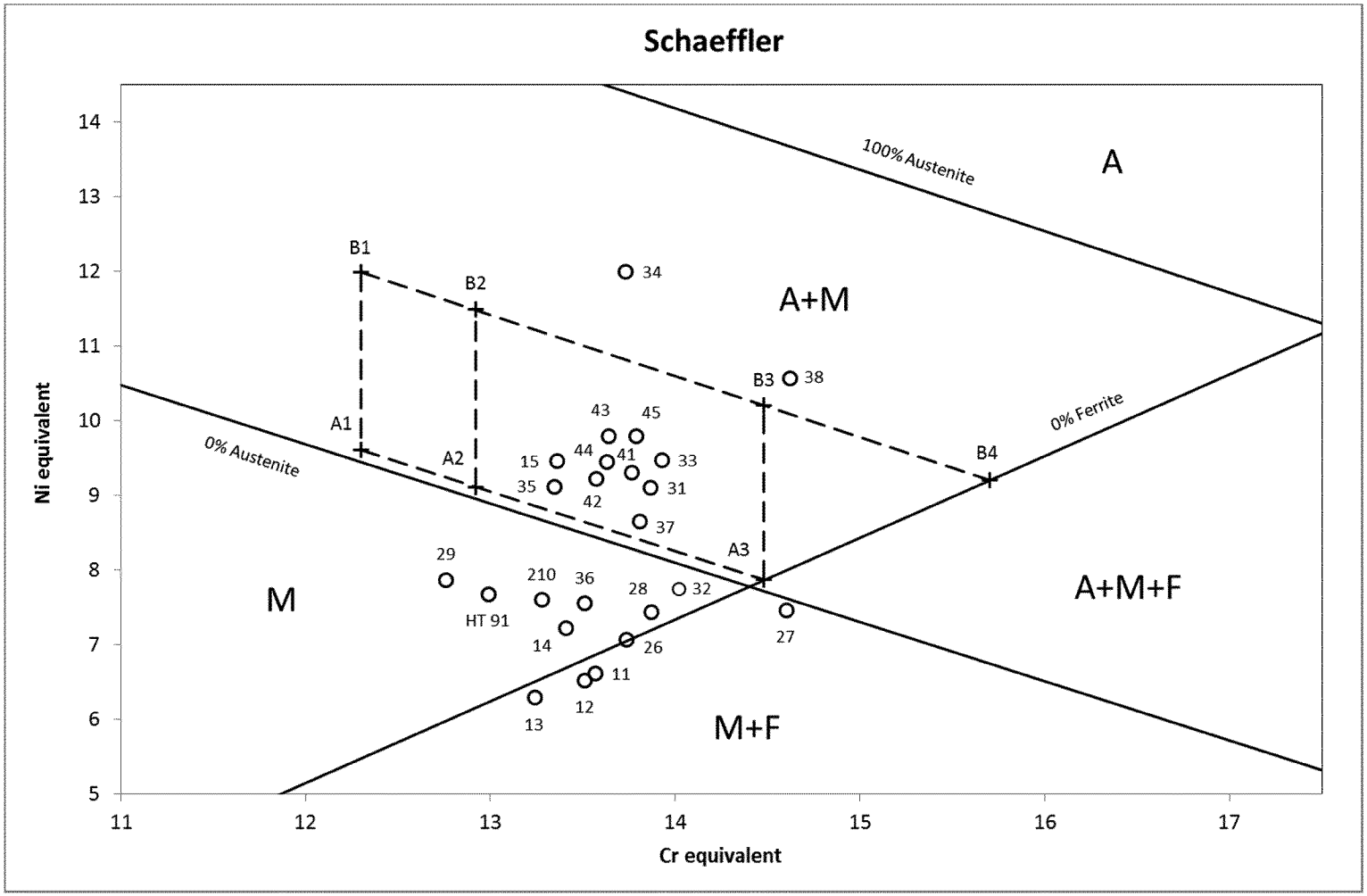
FIG. 2 shows the same Schaeffler diagram as FIG. 1 but the manufactured alloys of the Examples have been marked in the diagram.
Figure 3:
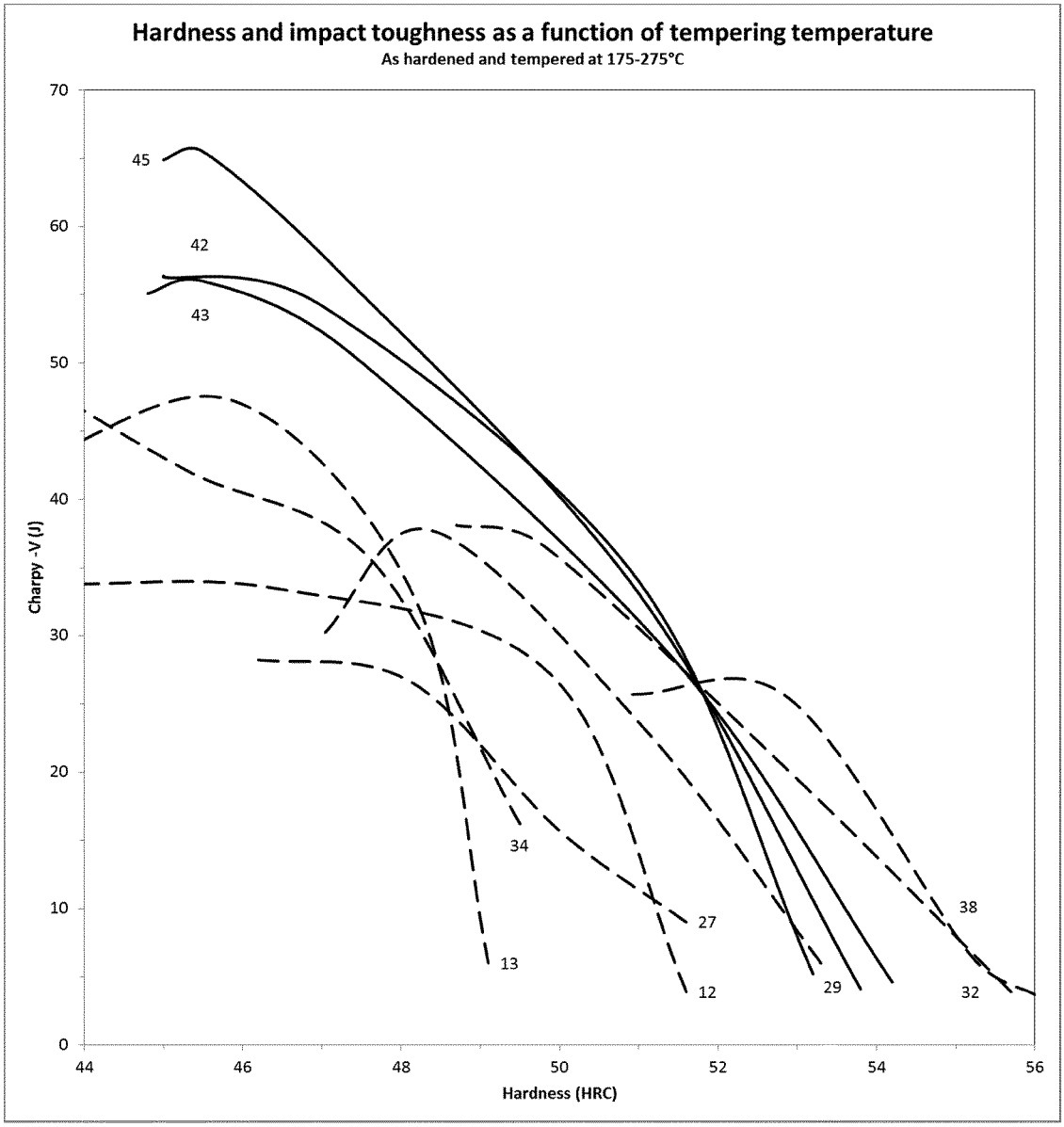
FIG. 3 shows the hardness and impact toughness curves for some of the alloys of the Examples.

The Cr- and Ni-equivalents, i.e. the $Cr_{eq}$ and the $Ni_{eq}$ values, for all alloys of the examples are shown in Table 2 and in FIG. 2. The $Cr_{eq}$ and the $Ni_{eq}$ values have been calculated according to the formulas given above in the present disclosure. The PRE-values for each alloy were calculated according to the following equation: PRE=Cr (wt %)+3.3*Mo (wt %).

The corrosion testing was performed by dynamic polarization measurements, either by (Corr 1) immersing a sample in a NaCl-solution (600 mg/l) at room temperature using a voltage scan rate of 10 mV/min, or by (Corr 2) immersing a sample in a NaCl-solution (600 mg/l) at room temperature using a voltage scan rate of 75 mV/min. The breakthrough potential, Ep (V), of the passive oxide film on the steel surface was then measured. The results are based on the average of two samples for each alloy. Before corrosion testing, all samples had been hardened at 1030-1050° C./0.5 h, quenched in oil, and tempered at 200-225° C./1 h. The result of the corrosion testing is shown in Table 2.

Mechanical testing in the form of hardness testing (HRC) and impact toughness testing on notched Charpy-V samples with the dimensions of 10×10×55 mm, was performed at room temperature on all alloys. The samples were hardened at 1030° C./0.5 h[1)] or 1050° C./1 h[2)], quenched in oil and thereafter tempered at different temperatures, 175-275° C. for 1 h. The results of the as-hardened conditions are based on the average of two Charpy-V samples, while the results of the tempered conditions are based on the average of three Charpy-V samples.

The result of the mechanical testing is shown in Tables 3A and 3B.

Table 4 summarizes a relative ranking of the hot working properties, mechanical properties and the corrosion resistance, based on the experiences during the manufacturing and testing of the alloys of the Examples.

TABLE 1

Chemical composition in weight % (wt %).

| | Alloy | | | | | | | | | | | | |
|---|---|---|---|---|---|---|---|---|---|---|---|---|---|
| | 11[x] | 12[x] | 13[x] | 14[x] | 15[x] | 26[x] | 27[x] | 28[x] | 29[x] | 210[x] | HT 91[x] | 31[x] | 32[x] |
| C | 0.19 | 0.18 | 0.17 | 0.17 | 0.16 | 0.20 | 0.20 | 0.15 | 0.17 | 0.16 | 0.20 | 0.25 | 0.23 |
| Si | 0.27 | 0.28 | 0.24 | 0.17 | 0.30 | 0.33 | 1.26 | 0.32 | 0.40 | 0.69 | 0.44 | 0.29 | 0.92 |
| Mn | 0.40 | 0.50 | 0.48 | 0.50 | 0.48 | 0.46 | 0.52 | 0.51 | 0.48 | 0.78 | 0.49 | 0.44 | 0.44 |
| P | 0.004 | 0.004 | 0.003 | 0.004 | 0.005 | 0.004 | 0.007 | 0.004 | 0.004 | 0.004 | 0.014 | 0.006 | 0.006 |
| S | 0.006 | 0.007 | 0.007 | 0.007 | 0.007 | 0.005 | 0.007 | 0.007 | 0.006 | 0.007 | 0.007 | 0.005 | 0.004 |
| Cr | 13.15 | 13.09 | 12.06 | 13.15 | 12.72 | 13.24 | 12.71 | 13.39 | 11.36 | 11.57 | 11.35 | 13.43 | 12.64 |
| Ni | 0.29 | 0.03 | 0.41 | 0.43 | 3.82 | 0.03 | 0.42 | 0.22 | 0.64 | 0.58 | 0.53 | 0.30 | 0.26 |
| Co | — | <0.01 | <0.01 | <0.01 | — | <0.01 | <0.01 | <0.01 | <0.01 | <0.01 | — | <0.01 | <0.01 |
| Mo | <0.01 | <0.01 | 0.82 | <0.01 | 0.19 | <0.01 | <0.01 | <0.01 | 0.71 | 0.67 | 0.98 | <0.01 | <0.01 |

TABLE 1-continued

| Chemical composition in weight % (wt %). | | | | | | | | | | | | | |
|---|---|---|---|---|---|---|---|---|---|---|---|---|---|
| W | <0.01 | <0.01 | <0.01 | <0.01 | <0.01 | <0.01 | <0.01 | 0.01 | <0.01 | <0.01 | — | <0.01 | <0.01 |
| Nb | <0.03 | <0.03 | <0.03 | <0.03 | <0.03 | <0.03 | <0.03 | <0.03 | 0.18 | <0.01 | <0.03 | <0.01 | <0.01 |
| N | 0.014 | 0.028 | 0.018 | 0.048 | 0.020 | 0.027 | 0.026 | 0.082 | 0.063 | 0.061 | 0.030 | 0.036 | 0.012 |
| Ti | <0.005 | <0.005 | <0.005 | <0.003 | <0.003 | <0.005 | <0.003 | <0.003 | <0.005 | <0.005 | <0.05 | <0.005 | <0.005 |
| Cu | 0.005 | 0.006 | 0.006 | <0.010 | 0.096 | 1.81 | <0.010 | <0.010 | 0.009 | 0.30 | 0.05 | 0.006 | 0.007 |
| Al | <0.003 | <0.003 | <0.003 | <0.003 | <0.003 | <0.003 | <0.003 | <0.003 | 0.004 | 0.005 | <0.05 | 0.026 | <0.003 |
| V | 0.008 | 0.005 | 0.005 | 0.34 | 0.015 | 0.005 | 0.18 | 0.010 | 0.31 | 0.14 | 0.27 | 0.014 | 0.015 |

| | Alloy | | | | | | | | | | |
|---|---|---|---|---|---|---|---|---|---|---|---|
| | 33[x] | 34[x] | 35[x] | 36[x] | 37 | 38[x] | 41[x] | 42 | 43 | 44 | 45 |
| C | 0.24 | 0.24 | 0.22 | 0.23 | 0.23 | 0.26 | 0.24 | 0.21 | 0.24 | 0.24 | 0.23 |
| Si | 0.33 | 0.32 | 0.19 | 0.26 | 0.21 | 0.50 | 0.03 | 0.02 | 0.02 | 0.04 | 0.04 |
| Mn | 3.56 | 0.48 | 0.40 | 0.43 | 0.44 | 0.63 | 2.08 | 0.54 | 1.20 | 2.31 | 0.56 |
| P | 0.007 | 0.006 | 0.007 | 0.006 | 0.006 | 0.007 | 0.005 | 0.005 | 0.005 | 0.004 | 0.004 |
| S | 0.005 | 0.005 | 0.006 | 0.005 | 0.005 | 0.005 | 0.007 | 0.006 | 0.007 | 0.006 | 0.007 |
| Cr | 13.43 | 13.25 | 11.86 | 11.91 | 12.58 | 12.97 | 13.22 | 13.04 | 12.62 | 12.39 | 12.49 |
| Ni | 0.04 | 4.11 | 1.90 | 0.05 | 1.11 | 0.50 | 0.50 | 2.11 | 1.34 | 0.52 | 2.13 |
| Co | <0.01 | <0.01 | <0.01 | <0.01 | <0.01 | <0.01 | <0.01 | — | — | — | <0.01 |
| Mo | <0.01 | <0.01 | 1.20 | 1.21 | 0.91 | 0.90 | 0.50 | 0.50 | 0.99 | 1.18 | 1.24 |
| W | <0.01 | <0.01 | <0.01 | <0.01 | <0.01 | <0.01 | 0.01 | — | — | — | <0.01 |
| Nb | <0.01 | <0.01 | <0.01 | <0.01 | <0.01 | <0.01 | <0.01 | <0.01 | <0.01 | <0.01 | <0.01 |
| N | 0.015 | 0.015 | 0.014 | 0.013 | 0.014 | 0.065 | 0.019 | 0.018 | 0.022 | 0.019 | 0.016 |
| Ti | <0.003 | <0.003 | <0.003 | <0.003 | <0.003 | <0.003 | <0.003 | <0.003 | <0.003 | <0.003 | <0.003 |
| Cu | <0.010 | <0.010 | <0.010 | 1.30 | 0.70 | 0.017 | <0.010 | <0.010 | <0.010 | <0.010 | <0.010 |
| Al | <0.003 | <0.003 | <0.003 | <0.003 | <0.003 | <0.003 | <0.003 | <0.003 | 0.003 | 0.010 | 0.014 |
| V | 0.015 | 0.013 | 0.013 | 0.015 | 0.014 | 0.016 | 0.007 | 0.007 | 0.006 | 0.007 | 0.007 |

TABLE 2

| $Cr_{eq}$, $Ni_{eq}$, PRE and Corrosion results, Ep (V). | | | | | | | | | | | | | |
|---|---|---|---|---|---|---|---|---|---|---|---|---|---|
| | Alloy | | | | | | | | | | | | |
| | 11[x] | 12[x] | 13[x] | 14[x] | 15[x] | 26[x] | 27[x] | 28[x] | 29[x] | 210[x] | HT 91[x] | 31[x] | 32[x] |
| $Cr_{eq}$ | 13.56 | 13.51 | 13.24 | 13.41 | 13.36 | 13.74 | 14.60 | 13.87 | 12.76 | 13.28 | 12.99 | 13.87 | 14.02 |
| $Ni_{eq}$ | 6.61 | 6.52 | 6.29 | 7.22 | 9.46 | 7.07 | 7.46 | 7.44 | 7.87 | 7.60 | 7.68 | 9.10 | 7.74 |
| PRE | 13.2 | 13.1 | 14.8 | 13.2 | 13.3 | 13.2 | 12.7 | 13.4 | 13.7 | 13.8 | 14.6 | 13.4 | 12.6 |
| Corr 1 | — | — | 0.44 | — | — | 0.44 | 0.43 | 0.46 | — | — | 0.42 | — | — |
| Corr 2 | — | — | — | — | — | — | — | — | — | — | — | — | — |

| | Alloy | | | | | | | | | | |
|---|---|---|---|---|---|---|---|---|---|---|---|
| | 33[x] | 34[x] | 35[x] | 36[x] | 37 | 38[x] | 41[x] | 42 | 43 | 44 | 45 |
| $Cr_{eq}$ | 13.93 | 13.73 | 13.35 | 13.51 | 13.81 | 14.62 | 13.77 | 13.57 | 13.64 | 13.63 | 13.79 |
| $Ni_{eq}$ | 9.47 | 12.00 | 9.12 | 7.56 | 8.65 | 10.57 | 9.31 | 9.22 | 9.80 | 9.45 | 9.79 |
| PRE | 13.4 | 13.3 | 15.8 | 15.9 | 15.6 | 15.9 | 14.9 | 14.7 | 15.9 | 16.3 | 16.6 |
| Corr 1 | 0.50 | — | 0.34 | — | — | — | — | — | 0.465 | — | — |
| Corr 2 | — | — | — | — | — | — | 0.373 | 0.418 | 0.490 | 0.494 | 0.616 |

TABLE 3A

| Hardness results (HRC) at room temperature after hardening and tempering at different tempering temperatures. | | | | | | | | | | | | | |
|---|---|---|---|---|---|---|---|---|---|---|---|---|---|
| | Alloy | | | | | | | | | | | | |
| | 11[1)x] | 12[1)x] | 13[1)x] | 14[1)x] | 15[1)x] | 26[1)x] | 27[1)x] | 28[1)x] | 29[1)x] | 210[1)x] | HT 91[1)x] | 31[2)x] | 32[2)x] |
| As-hardened | 51.0 | 51.6 | 49.1 | 51.8 | 49.0 | 53.6 | 51.6 | 51.7 | 53.3 | 52.3 | — | 57.3 | 55.7 |
| 175° C. | 48.6 | 49.9 | 48.2 | 50.0 | 46.3 | 50.3 | 50.0 | 50.0 | 51.1 | 50.2 | 48.5 | 54.3 | 53.0 |
| 225° C. | 45.0 | 46.5 | 45.9 | 46.9 | 42.4 | 46.2 | 48.1 | 46.8 | 48.4 | 48.1 | 47.5 | 50.3 | 49.8 |
| 250° C. | — | — | — | — | — | — | — | — | — | — | — | — | — |
| 275° C. | 40.7 | 43.6 | 43.3 | 44.2 | 40.9 | 43.3 | 46.1 | 44.7 | 47.0 | 46.1 | 45.1 | 47.1 | 48.7 |

TABLE 3A-continued

Hardness results (HRC) at room temperature after hardening and tempering at different tempering temperatures.

| | Alloy | | | | | | | | | | |
|---|---|---|---|---|---|---|---|---|---|---|---|
| | 33[2x)] | 34[2)x] | 35[2)x] | 36[2)x] | 37[2)] | 38[2x)] | 41[2)x] | 42[2)] | 43[2)] | 44[2)] | 45[2)] |
| As-hardened | 54.6 | 49.5 | 55.1 | 54.9 | 54.8 | 56.0 | 54.8 | 53.2 | 54.2 | 54.0 | 53.8 |
| 175° C. | 52.5 | 47.6 | 52.0 | 52.1 | 52.0 | 55.2 | 51.8 | 51.0 | 51.5 | 51.3 | 51.0 |
| 225° C. | 49.0 | 45.3 | 48.5 | 48.0 | 48.4 | 52.9 | 47.8 | 47.0 | 47.3 | 47.5 | 47.2 |
| 250° C. | — | — | — | — | — | — | 45.4 | 45.0 | 45.5 | 46.0 | 45.5 |
| 275° C. | 46.1 | 43.0 | 45.8 | 45.9 | 45.6 | 50.9 | 45.2 | 45.0 | 44.8 | 45.5 | 45.0 |

TABLE 3B

Impact Toughness results, Charpy-V (J), at room temperature after hardening and tempering at different tempering temperatures.

| | Alloy | | | | | | | | | | | | |
|---|---|---|---|---|---|---|---|---|---|---|---|---|---|
| | 11[1)x] | 12[1)x] | 13[1)x] | 14[1)x] | 15[1)x] | 26[1)x] | 27[1)x] | 28[1)x] | 29[1)x] | 210[1)x] | HT 91[1)x] | 31[2)x] | 32[2)x] |
| As-hardened | 3.4 | 3.9 | 6.0 | 6.4 | 15.8 | 7.0 | 9.0 | 8.0 | 6.0 | 6.0 | — | 3.7 | 3.9 |
| 175° C. | 27.0 | 27.1 | 32.4 | 11.4 | 47.2 | 17.7 | 15.7 | 14.0 | 23.0 | 14.7 | 21.0 | 7.9 | 19.5 |
| 225° C. | 40.2 | 33.4 | 47.2 | 25.2 | 56.0 | 42.7 | 26.7 | 30.7 | 37.7 | 19.3 | 34.5 | 27.1 | 36.6 |
| 250° C. | — | — | — | — | — | — | — | — | — | — | — | — | — |
| 275° C. | 36.3 | 33.8 | 42.7 | 25.7 | 58.7 | 43.0 | 28.3 | 35.0 | 30.0 | 16.0 | 38.8 | 35.1 | 38.1 |

| | Alloy | | | | | | | | | | |
|---|---|---|---|---|---|---|---|---|---|---|---|
| | 33[2)x] | 34[2)x] | 35[2)x] | 36[2)x] | 37[2)] | 38[2)x] | 41[2)x] | 42[2)] | 43[2)] | 44[2)] | 45[2)] |
| As-hardened | 5.5 | 16.2 | 5.4 | 4.5 | 4.2 | 3.7 | 5.2 | 5.2 | 4.6 | 3.5 | 4.1 |
| 175° C. | 25.5 | 35.7 | 33.8 | 17.8 | 24.0 | 6.5 | 12.5 | 34.0 | 27.9 | 27.2 | 33.1 |
| 225° C. | 43.3 | 42.1 | 47.5 | 36.0 | 43.8 | 25.4 | 47.7 | 54.2 | 51.0 | 61.2 | 56.8 |
| 250° C. | — | — | — | — | — | — | 49.2 | 56.3 | 56.0 | 60.4 | 65.5 |
| 275° C. | 50.8 | 50.0 | 49.2 | 42.2 | 46.3 | 25.7 | 48.4 | 56.4 | 55.1 | 63.4 | 64.9 |

TABLE 4

Relative ranking of the alloys of the Examples.

| | Alloy | | | | | | | | | | | |
|---|---|---|---|---|---|---|---|---|---|---|---|---|
| | 11[x] | 12[x] | 13[x] | 14[x] | 15[x] | 26[x] | 27[x] | 28[x] | 29[x] | 210[x] | HT 91[x] | 31[x] |
| Hot working Properties | Average | Average | Average | Average | Average | Average | Average | Average | Average | Average | — | Excellent |
| Mechanical Properties | Average | Average | Better | Poorer | Better | Average | Poorer | Poorer | Better | Worst | Average | Average |
| Corrosion Resistance | — | — | Better | — | — | Better | Better | Best | — | — | Better | — |

| | Alloy | | | | | | | | | | | |
|---|---|---|---|---|---|---|---|---|---|---|---|---|
| | 32[x] | 33[x] | 34[x] | 35[x] | 36[x] | 37 | 38[x] | 41[x] | 42 | 43 | 44 | 45 |
| Hot working Properties | Better | Poorer | Excellent | Best | Poorer | Best | Better | Best | Best | Best | Best | Excellent |
| Mechanical Properties | Better | Best | Better | Best | Better | Best | Poorer | Better | Best | Best | Excellent | Excellent |
| Corrosion Resistance | — | Best | — | Average | — | — | — | Average | Better | Best | Best | Excellent |

Example 2—Manufacture of a Drill Rod

The drill rod was manufactured from a rod containing of the alloy 45 of Example 1.

Blooms were produced by performing conventional metallurgical processes in a steel plant. The blooms were hot rolled to round rods. Then, the rods were soft annealed and cut into pieces of suitable length.

After rolling, soft annealing and cutting, long, straight center holes were drilled in the rods, which thus became drill steel blanks. Cores were inserted in the holes before heating the blanks. The blanks were then hot-rolled into finished dimensions of round drill steel rods. The drill steel rods were then cooled and the cores were taken out of the center holes of the drill steel rods. The drill steel rods were then soft annealed at a temperature of 640° C. for at least 6 hours, to facilitate machining.

After machining of threads and other cutting operations, the drill steel rods were hardened in a temperature between 1030-1130° C. and thereafter quenched in oil. Immediately after quenching and cooling to room temperature, the drill steel rods were then tempered at a temperature between 175-275° C. for at least 1 hour. After tempering, the drill steel rods were cooled to room temperature. Shot peening was then performed to enhance the fatigue strength of the drill steel rods. Finally, straightening of the drill steel rods was performed.

The invention claimed is:

1. A drill component comprising a martensitic stainless steel having a composition comprising in weight % (wt %):

| |
|---|
| C 0.21 to 0.27; |
| Si less than or equal to 0.7; |
| Mn 0.2 to 2.5; |
| P less than or equal to 0.03; |
| S less than or equal to 0.05; |
| Cr 11.9 to 14.0; |
| Ni 1.9 to 3.0; |
| Mo 0.4 to 1.5; |
| N less than or equal to 0.016; |
| Cu less than or equal to 1.2; |
| V less than or equal to 0.06; |
| Nb less than or equal to 0.03; |
| Al less than or equal to 0.050; |
| Ti less than or equal to 0.05; |

balance Fe and unavoidable impurities, wherein the martensitic stainless steel comprises more than or equal to 75% martensite phase and less than or equal to 25% retained austenite phase, wherein said martensitic stainless steel has a PRE-value more than or equal to 14, wherein the composition of the martensitic stainless steel is within an area formed in a Schaeffler diagram, which diagram is based on the following equations:

$$Cr_{eq}=Cr+Mo+1.5*Si+0.5*Nb \quad \text{(x-axis)}$$

$$Ni_{eq}=Ni+0.5*Mn+30*N+30*C \quad \text{(y-axis)}$$

wherein the values of Cr, Mo, Si, Nb, Ni, Mn, N and C are in weight %, and wherein the area is defined by the following coordinates:

| | $Cr_{eq}$ | $Ni_{eq}$ |
|---|---|---|
| A1 | 12.300 | 9.602 |
| B1 | 12.300 | 11.990 |

-continued

| | $Cr_{eq}$ | $Ni_{eq}$ |
|---|---|---|
| B4 | 15.702 | 9.199 |
| A3 | 14.482 | 7.864. |

2. The drill component according to claim 1, wherein said martensitic stainless steel comprises of from 80 to 95% martensite phase and of from 5 to 20% retained austenite phase.

3. The drill component according to claim 1, wherein the martensitic stainless steel has a content of Si that is less than or equal to 0.4 wt %.

4. The drill component according to claim 1, wherein the martensitic stainless steel has a content of N that is 0.012-0.016 wt %.

5. The drill component according to claim 1, wherein the martensitic stainless steel has a content of Cu that is less than or equal to 0.8 wt %.

6. The drill component according to claim 1, wherein the martensitic stainless steel has a content of C that is of from 0.21 to 0.26 wt %.

7. The drill component according to claim 1, wherein the martensitic stainless steel has a content of Cr that is of from 12.0 to 13.8 wt %.

8. The drill component according to claim 1, wherein the martensitic stainless steel has a content of Mn that is of from 0.3 to 2.4 wt %.

9. The drill component according to claim 1, wherein the martensitic stainless steel has a content of Ni 1.9 to 2.4 wt %.

10. The drill component according to claim 1, wherein the martensitic stainless steel has a content of Mo is of from 0.5 to 1.4 wt %.

11. The drill component according to claim 1, wherein the area is defined by the following coordinates:

| | $Cr_{eq}$ | $Ni_{eq}$ |
|---|---|---|
| A2 | 12.923 | 9.105 |
| B2 | 12.923 | 11.479 |
| B4 | 15.702 | 9.199 |
| A3 | 14.482 | 7.864. |

12. The drill component according to claim 1, wherein the area is defined by the following coordinates:

| | $Cr_{eq}$ | $Ni_{eq}$ |
|---|---|---|
| A1 | 12.300 | 9.602 |
| B1 | 12.300 | 11.990 |
| B3 | 14.482 | 10.200 |
| A3 | 14.482 | 7.864. |

13. The drill component according to claim 1, wherein the area is defined by the following coordinates:

| | $Cr_{eq}$ | $Ni_{eq}$ |
|---|---|---|
| A2 | 12.923 | 9.105 |
| B2 | 12.923 | 11.479 |
| B3 | 14.482 | 10.200 |
| A3 | 14.482 | 7.864. |

14. The drill component according to claim 1, wherein the drill component is a drill rod.

15. The drill component according to claim 1, wherein the composition further comprises in weight % (wt %):

W less than or equal to 0.5;

Co less than or equal to 1.0;

Zr less than or equal to 0.03;

Ta less than or equal to 0.03; and

Hf less than or equal to 0.03.

16. The drill component according to claim 1, wherein the composition further comprises in weight % (wt %):

| |
|---|
| C 0.21 to 0.27; |
| Si 0.02 to 0.5; |
| Mn 0.2 to 2.5; |
| P less than or equal to 0.03; |
| S less than or equal to 0.05; |
| Cr 11.86 to 13.43; |
| Ni 1.9 to 3.0; |
| Mo 0.5 to 1.24; |
| N less than or equal to 0.016; |

-continued

| |
|---|
| Cu less than or equal to 0.7; |
| V less than or equal to 0.06; |
| Nb less than or equal to 0.03; |
| Al less than or equal to 0.050; |
| Ti less than or equal to 0.05; |

balance Fe and unavoidable impurities.

17. The drill component according to claim 16, wherein the composition further comprises in weight % (wt %):

W less than or equal to 0.5;

Co less than or equal to 1.0;

Zr less than or equal to 0.03;

Ta less than or equal to 0.03; and

Hf less than or equal to 0.03.

18. The drill component according to claim 16, wherein said martensitic stainless steel comprises of from 80 to 95% martensite phase, of from 5 to 20% retained austenite phase, and does not contain any ferrite phase.

* * * * *